US005834905A

United States Patent [19]

Godyak et al.

[11] Patent Number: 5,834,905

[45] Date of Patent: Nov. 10, 1998

[54] HIGH INTENSITY ELECTRODELESS LOW PRESSURE LIGHT SOURCE DRIVEN BY A TRANSFORMER CORE ARRANGEMENT

[75] Inventors: Valery A. Godyak; Benjamin Alexandrovich, both of Brookline; Robert B. Piejak, Wayland, all of Mass.; Eugene Statnic, Munich, Germany

[73] Assignee: Osram Sylvania Inc., Danvers, Mass.

[21] Appl. No.: 624,043

[22] Filed: Mar. 27, 1996

Related U.S. Application Data

[60] Provisional application No. 60/003,827 Sep. 15, 1995.

[51] Int. Cl.[6] ..... H01J 65/04

[52] U.S. Cl. ..... 315/248; 315/267; 315/344

[58] Field of Search ..... 315/248, 267, 315/344, 39, 57, 62

[56] References Cited

U.S. PATENT DOCUMENTS

| | | | |
|---|---|---|---|
| 3,500,118 | 3/1970 | Anderson . | |
| 3,987,334 | 10/1976 | Anderson | 315/57 |
| 4,017,764 | 4/1977 | Anderson | 315/267 X |
| 4,180,763 | 12/1979 | Anderson | 315/248 |
| 4,253,047 | 2/1981 | Walker et al. | 315/248 |
| 4,864,194 | 9/1989 | Kobayashi et al. | 315/248 |
| 5,146,140 | 9/1992 | Piejak et al. | 315/248 |

FOREIGN PATENT DOCUMENTS

| | | |
|---|---|---|
| 7-94151 | 4/1995 | Japan . |
| 7-94152 | 4/1995 | Japan . |

OTHER PUBLICATIONS

J. Schlejen, Inductively Coupled Fluorescent Lamps: 'The QL Lighting System', (no date).

Netten, A., Verheij, C. M. (1991), The Operating Principles of the Philips QL Lamp System, pp. 1–15.

Anderson, John M., Electrodeless Fluorescent Lamps Excited by Solenoidal Electric Fields, Illuminating Engineering (Apr. 1969), pp. 236–244.

*Primary Examiner*—Benny T. Lee

[57] ABSTRACT

An electric lamp assembly includes an electrodeless lamp having a closed-loop, tubular envelope enclosing mercury vapor and a buffer gas at a pressure less than about 0.5 torr, a transformer core disposed around the lamp envelope, an input winding disposed on the transformer core and a radio frequency power source coupled to the input winding. The radio frequency source supplies sufficient radio frequency energy to the mercury vapor and the buffer gas to produce in the lamp envelope a discharge having a discharge current equal to or greater than about 2 amperes. The electrodeless lamp preferably includes a phosphor on an inside surface of the lamp envelope for emitting radiation in a predetermined wavelength range in response to ultraviolet radiation emitted by the discharge.

32 Claims, 3 Drawing Sheets

HIGH INTENSITY ELECTRODELESS LOW PRESSURE LIGHT SOURCE DRIVEN BY A TRANSFORMER CORE ARRANGEMENT

CROSS-REFERENCE TO A RELATED APPLICATION

This application claims the benefit of U.S. Provisional Application No. 60/003827, filed Sep. 15, 1995.

FIELD OF THE INVENTION

This invention relates to electric lamps and, more particularly, to a low pressure, high intensity fluorescent light source that can produce considerably more light per unit length than conventional electroded fluorescent lamps.

BACKGROUND OF THE INVENTION

Very high output (VHO) fluorescent lamps and metal halide high intensity discharge (HID) arc lamps provide efficient, high lumen output and good color rendering. The VHO fluorescent lamp is based on conventional electroded fluorescent technology. For the electrodes to have a long life (about 10,000 hours), the buffer gas pressure in these lamps is about 2 torr, and the discharge current is typically less than 1.5 amperes. To minimize saturation in ultraviolet radiation and thus provide acceptable efficacy, VHO fluorescent lamps operate with a relatively light gas, such as neon, at buffer gas pressures of about 2 torr. The requirements for long life and efficacy limit the parameter space in which these lamps can operate, and ultimately this restricts the maximum axial light density that these lamps can produce efficiently. Thus, VHO fluorescent lamps are relatively long for the amount of light they produce, and their efficacy is moderate, typically no more than about 70 lumens per watt. However, because VHO fluorescent lamps can be tailored to provide a uniform, stable and rich color spectrum, they are widely used in large stores where good, stable color rendering and instant turn on and turn off are required.

The metal halide HID lamp is an arc lamp that is considerably more compact than the VHO fluorescent lamp. The overall length of the entire lamp (including shroud) may be about 8 or 10 inches. The life of an HID lamp is typically 7,000 to 10,000 hours. HID lamp operation is quite different from that of low pressure fluorescent lamps in that the HID discharge typically operates at a gas pressure of a few atmospheres. Since it takes about 5–10 minutes to build up this gas pressure, the HID lamp does not emit substantial light immediately. Additionally, if power is interrupted, even for an instant, HID lamps may require 10 or more minutes to restart. Furthermore, the color rendering and overall lumen output of HID lamps is somewhat variable over life, and the lamps should be replaced at the end of life to avoid possible catastrophic failure of the hot lamp. The HID lamp is widely used in outdoor applications such as street lamps, tunnels and stadiums.

An inductively coupled fluorescent lamp known as the QL lighting system includes a lamp envelope having the shape of a conventional incandescent lamp with a reentrant cavity, a power coupler positioned in the reentrant cavity and a high frequency generator. The QL lighting system is relatively complex in construction and requires cooling. In addition, the QL lighting system typically operates at a frequency of 2.65 MHz, a frequency at which care must be taken to prevent radio frequency interference.

Electrodeless fluorescent lamps are disclosed in U.S. Pat. No. 3,500,118 issued Mar. 10, 1970 to Anderson; U.S. Pat. No. 3,987,334 issued Oct. 19, 1976 to Anderson; and Anderson, *Illuminating Engineering*, April 1969, pages 236–244. An electrodeless, inductively-coupled lamp includes a low pressure mercury/buffer gas discharge in a discharge tube which forms a continuous closed electrical path. The path of the discharge tube goes through the center of one or more toroidal ferrite cores such that the discharge tube becomes the secondary of a transformer. Power is coupled to the discharge by applying a sinusoidal voltage to a few turns of wire wound around the toroidal core that encircles the discharge tube. The current through the primary winding creates a time varying magnetic flux which induces along the discharge tube a voltage that maintains the discharge. The inner surface of the discharge tube is coated with a phosphor which emits visible light when irradiated by photons emitted by the excited mercury gas atoms.

The electrodeless lamp described by Anderson has a discharge current between 0.25 and 1.0 ampere, and a buffer gas pressure between 0.5 and 5 torr. Argon was used as a buffer gas in the electrodeless lamp described by Anderson. In addition, about 2.5 kilograms of ferrite material were used to energize a 32 watt discharge in the electrodeless lamp described by Anderson. The lamp parameters described by Anderson produce a lamp which has high core loss and therefore is extremely inefficient. In addition, the Anderson lamp is impractically heavy because of the ferrite material used in the transformer core.

SUMMARY OF THE INVENTION

According to the present invention, an electric lamp assembly comprises an electrodeless lamp including a closed-loop, tubular lamp envelope enclosing mercury vapor and a buffer gas at a pressure less than about 0.5 torr, a transformer core disposed around the lamp envelope, an input winding disposed on the transformer core and a radio frequency power source coupled to the input winding. The radio frequency source supplies sufficient radio frequency energy to the mercury vapor and the buffer gas to produce in the lamp envelope a discharge having a discharge current equal to or greater than about 2 amperes.

Preferably, the electrodeless lamp includes a phosphor on an inside surface of the lamp envelope for emitting radiation in a predetermined wavelength range in response to ultraviolet radiation emitted by the discharge. The lamp envelope preferably has a cross sectional dimension in a range of about 1 to 4 inches. In a first embodiment, the lamp envelope has an oval shape. In a second embodiment, the lamp envelope comprises first and second parallel tubes joined at their ends to form a closed loop. The buffer gas is preferably a noble gas such as krypton.

The radio frequency power source preferably has a frequency in a range of about 50 kHz to about 3 MHz and, more preferably, in a range of about 100 kHz to about 400 kHz. The transformer core preferably has a toriodal configuration that encircles the lamp envelope. Preferably, the transformer core comprises a ferrite material. The core power loss is preferably less than or equal to 5% of the total power supplied by the radio frequency power source.

According to another aspect of the invention, an electric lamp assembly comprises an electrodeless lamp including a tubular lamp envelope enclosing mercury vapor and a buffer gas at a pressure less than about 0.5 torr. The lamp envelope comprises first and second parallel tubes, which may be straight tubes, joined at or near one end by a first lateral tube and joined at or near the other end by a second lateral tube to form a closed loop. The electric lamp assembly further comprises a first transformer core disposed around the first lateral tube of the lamp envelope, a second transformer core disposed around the second lateral tube of the lamp envelope, first and second input windings disposed on the first and second transformer cores, respectively, and a radio frequency power source coupled to the first and second input windings. The radio frequency power source supplies sufficient radio frequency energy to the mercury vapor and the buffer gas to produce in the lamp envelope a discharge having a discharge current equal to or greater than about 2 amperes.

According to yet another aspect of the invention, a method is provided for operating an electric lamp comprising an electrodeless lamp including a closed-loop, tubular lamp envelope enclosing a buffer gas and mercury vapor. The method comprises the steps of establishing in the lamp envelope a pressure of the mercury vapor and the buffer gas less than about 0.5 torr, and inductively coupling sufficient radio frequency energy to the mercury vapor and the buffer gas to produce in the lamp envelope a discharge having a discharge current equal to or greater than about 2 amperes.

According to a further aspect of the invention, an electric lamp assembly comprises an electrodeless lamp including a closed-loop, tubular lamp envelope enclosing mercury vapor and a buffer gas at a pressure less than about 0.5 torr, and means for inductively coupling sufficient radio frequency energy to the mercury vapor and the buffer gas to produce in the lamp envelope a discharge having a discharge current equal to or greater than about 2 amperes.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
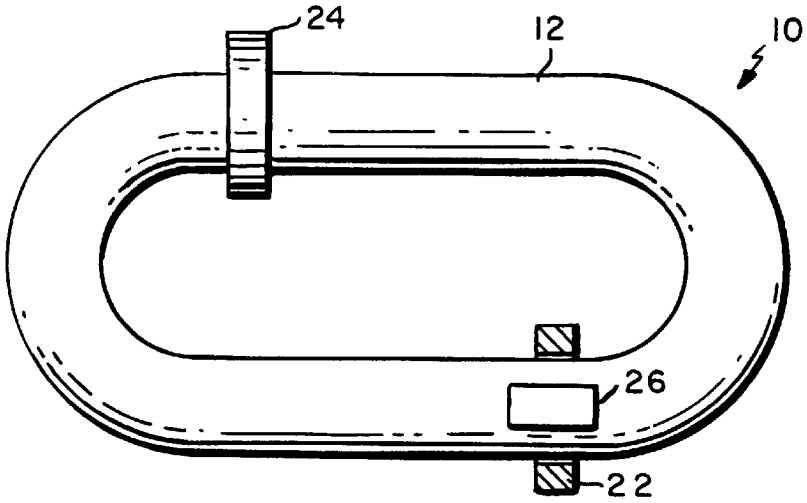
FIG. 1 is a schematic representation of a first embodiment of an electrodeless fluorescent lamp in accordance with the invention.
Figure 2:
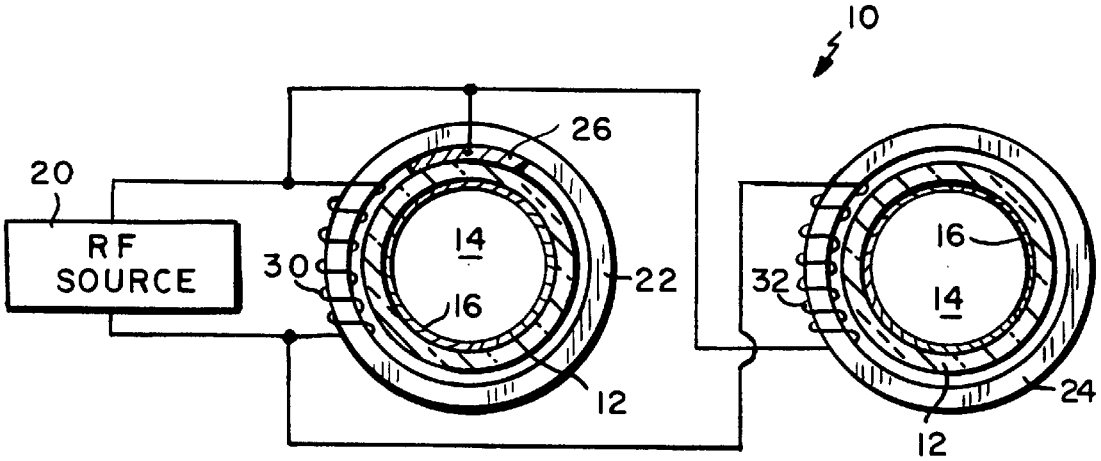
FIG. 2 is a schematic diagram showing electrical connections to the electrodeless fluorescent lamp of the present invention.

A first embodiment of a discharge lamp in accordance with the present invention is shown in FIGS. 1 and 2. A lamp 10 includes a lamp envelope 12 which has a tubular, closed-loop configuration and is electrodeless. The lamp envelope 12 encloses a discharge region 14 (FIG. 2) containing a buffer gas and mercury vapor. A phosphor coating 16 (FIG. 2) is typically formed on the inside surface of lamp envelope 12. Radio frequency (RF) energy from an RF source 20 (FIG. 2) is inductively coupled to the electrodeless lamp 10 by a first transformer core 22 and a second transformer core 24. Each of the transformer cores 22 and 24 preferably has a toroidal configuration that surrounds lamp envelope 12. The RF source 20 is connected to a winding 30 (FIG. 2) on first transformer core 22 and is connected to a winding 32 (FIG. 2) on second transformer core 24. A conductive strip 26, adhered to the outer surface of lamp envelope 12 and electrically connected to RF source 20, may be utilized to assist in starting a discharge in electrodeless lamp 10.

In operation, RF energy is inductively coupled to a low pressure discharge within lamp envelope 12 by the transformer cores 22 and 24. The electrodeless lamp 10 acts as a secondary circuit for each transformer. The windings 30 and 32 are preferably driven in phase and may be connected in parallel as shown in FIG. 2. The transformers 22 and 24 are positioned on lamp envelope 12 such that the voltages induced in the discharge by the transformer cores 22 and 24 add. The RF current through the windings 30 and 32 creates a time-varying magnetic flux which induces along the lamp envelope 12 a voltage that maintains a discharge. The discharge within lamp envelope 12 emits ultraviolet radiation which stimulates emission of visible light by phosphor coating 16. In this configuration, the lamp envelope 12 is fabricated of a material, such as glass, that transmits visible light. One suitable glass is Pyrex (tradename) a heat-resistant and chemical-resistant glass. Alternatively, the envelope may be constructed from a soft glass, such as soda-lime, with an internal surface coated with a barrier layer, such as aluminum oxide. In an alternative configuration, the electrodeless lamp is used as a source of ultraviolet radiation. In this configuration, the phosphor coating 16 is omitted, and the lamp envelope 12 is fabricated of an ultraviolet-transmissive material, such as quartz.

The lamp envelope preferably has a diameter in the range of about 1 inch to about 4 inches for high lumen output. The fill material comprises a buffer gas and a small amount of mercury which produces mercury vapor. The buffer gas is preferably a noble gas and is most preferably krypton. It has been found that krypton provides higher lumens per watt in the operation of the lamp at moderate power loading. At higher power loading, use of argon may be preferable. The lamp envelope 12 can have any shape which forms a closed loop, including an oval shape as shown in FIG. 1, a circular shape, an elliptical shape or a series of straight tubes joined to form a closed loop as described below.

The transformer cores 22 and 24 are preferably fabricated of a high permeability, low loss ferrite material, such as a manganese zinc ferrite. The transformer cores 22 and 24 form a closed-loop around lamp envelope 12 and typically have a toroidal configuration with a diameter that is slightly larger than the outside diameter of lamp envelope 12. The cores 22 and 24 are cut in order to install them on lamp envelope 12. The cut ends are preferably polished in order to minimize any gap between the ends of each transformer core after installation on lamp envelope 12.

Because the ferrite material of the transformer cores is relatively expensive, it is desirable to limit the amount used. In one approach, a small section of the lamp envelope is necked down to a smaller diameter and a transformer core of smaller diameter is positioned on the smaller diameter section of the lamp envelope. The length of the smaller diameter section of the lamp envelope should be kept to a minimum in order to minimize the discharge voltage. In another approach, a single transformer core is used to couple RF energy to the discharge.

The windings 30 and 32 may each comprise a few turns of wire of sufficient size to carry the primary current. Each transformer is configured to step down the primary voltage and to step up the primary current, typically by a factor of about 5 to 10. Typically, the primary windings 30 and 32 may each have about 8 to 12 turns.

The RF source 20 is preferably in a range of about 50 kHz to 3 MHz and is most preferably in a range of about 100 kHz to about 400 kHz. By way of example, a primary voltage in a range of about 100 to 200 volts and a primary current of about 1 ampere may produce a discharge voltage of 20 to 30 volts and a discharge current on the order of about 5 amperes.

The electric lamp assembly of the present invention utilizes a combination of parameters which produce high lumen output, high lumens per watt, low core loss and long operating life. It has been determined that a buffer gas pressure less than about 0.5 torr and a discharge current equal to or greater than about 2.0 amperes produces the desired performance. Preferably, the buffer gas pressure is equal to or less than about 0.2 torr, and the discharge current is equal to or greater than about 5.0 amperes. At large tube diameters, the performance of the lamp assembly of the present invention meets or exceeds the lumen output and lumens per watt performance of conventional very high output electroded fluorescent lamps.

It has been found important to minimize discharge voltage in an inductively coupled discharge, because ferrite core loss increases sharply with discharge voltage. The heavier atomic weight of the buffer gas, the larger tube diameter and the higher current operation in comparison with prior art electrodeless fluorescent lamps result in decreased discharge voltage. The lamp of the present invention requires only 0.4 kilograms of ferrite material to energize a 120 watt discharge. The core loss in this configuration is about 3%. In general, the transformer core power loss is typically less than or equal to 5% of the total power supplied by the RF source in the lamp of the present invention. Furthermore, the ratio of transformer core volume to discharge power is typically less than 1 cubic centimeter per watt in the lamp of the present invention.

Analysis of the lamp of the present invention indicates that the correct choice of discharge current has a crucial effect on the ferrite core loss that occurs when driving an inductive discharge. The issue of ferrite core loss and discharge current can be understood from the following analysis. Generally speaking, low pressure discharges have a negative voltage/current characteristic. Thus, discharge voltage $V_d$ is related to the discharge current $I_d$ such that discharge voltage $V_d$ is proportional to $I_d^{-k}$ where k represents the power of the relation between discharge voltage and discharge current. Since voltage and current are approximately in phase, discharge power $P_d$ is proportional to $I_d^{1-k}$. Ferrite core loss $P_c$ is proportional to the nth power of discharge voltage $V_d$, which is equal to the primary voltage divided by the number of turns on the transformer core. Thus, $P_c$ is proportional to $V_d^n$, (where n represents the power of the relation between core loss and discharge voltage) which in turn is proportional to $I_d^{-kn}$. The ratio of $P_c/P_d$, can be written as $$\xi = P_c/P_d \alpha I_d^{-[k(n-1)+1]}$$

Typically, 0.2<k<0.4 and 2.5<n<3.1. Taking k=0.3 and n=2.8 as representative values, the expression for ξ above reduces to $$\xi \alpha I_d^{-1.5}$$

For a given ferrite core, increasing discharge current from 0.5 amp to 5 amperes provides a reduction in ξ by $10^{-1.5}$, or about 30 times less core loss. This analysis explains the greater coupling efficiency that is obtained at higher discharge current. However, this does not imply that simply increasing the discharge current in prior art electrodeless fluorescent lamps would produce desirable lamp performance. It is also important to have the discharge power efficiently converted to ultraviolet radiation. To obtain efficient production of ultraviolet radiation from mercury at high current, it is important that the buffer gas pressure be less than about 0.5 torr. Thus, it is important to combine high discharge current with low buffer gas pressure. Preferably, the discharge current $I_d$ should be equal to or greater than about 2.0 amperes, and the buffer gas pressure should be less than about 0.5 torr.

Starting of a discharge in the electrodeless fluorescent lamp of the present invention is relatively easy. The output voltage of the RF source prior to starting of a discharge is typically two to three times the operating voltage. This voltage applied to conductive strip 26 on lamp envelope 12 is sufficient to initiate a discharge. Other starting devices may be utilized within the scope of the present invention. If desired, the conductive strip or other starting device may be switched out of the lamp circuit after initiation of a discharge.

An example of an electrodeless fluorescent lamp in accordance with the present invention is described with reference to the configuration of FIGS. 1 and 2. A lamp envelope consisted of a closed-loop discharge glass tube filled with a noble gas and mercury vapor, with the inside surface of the lamp envelope coated with phosphor. The length of the discharge path was 66 centimeters (cm), and the tube outside diameter was 38 millimeters (mm). The lamp envelope was filled with krypton at a pressure of 0.2 torr and about 6 millitorr of mercury vapor. Two toroidal ferrite cores (P-type made by Magnetics, a Division of Spang and Company) were cut into two pieces with the end of piece ground flat. Each toroidal core was assembled around the lamp envelope with six primary turns of wire wrapped around each ferrite core. The cores had an outside diameter of 75 mm, an inside diameter of 40 mm and a thickness of 12.6 mm, with a total cross section for the two cores of 4.4 square centimeters. The lamp was driven with a sinusoidal signal RF source at a frequency of 250 kHz. The performance of the lamp under one set of operating conditions was as follows. Discharge current was 5 amperes; discharge power was 120 watts, 1.8 watts per centimeter; light output was 10,000 lumens; lumens per watt was 80; ratio of core power loss to discharge power was 0.054; core volume was 80 cubic centimeters; ratio of core volume to discharge power was 0.67 cubic centimeters per watt; discharge voltage was 25 volts RMS; discharge field was 0.37 volts per centimeter; core flux density was 500 gauss; core loss was 6.5 watts, 0.08 watts per cubic centimeter; and total power was 126.5 watts.

Figure 3:
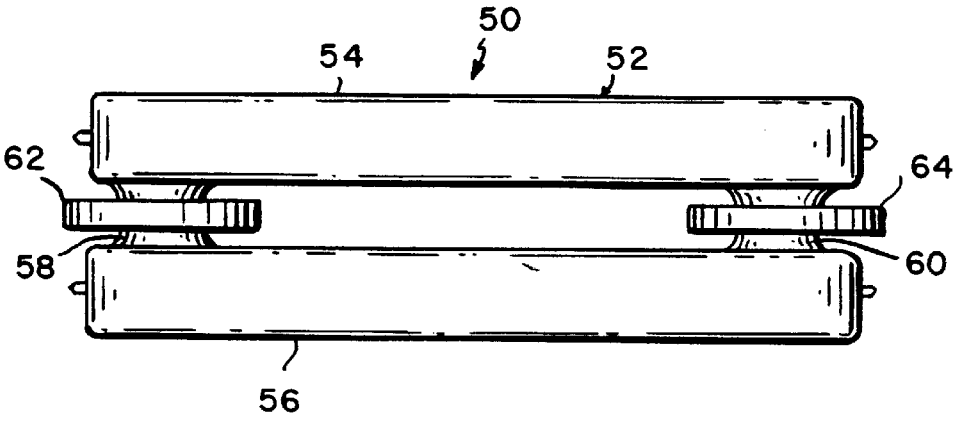
FIG. 3 is a schematic diagram of an electrodeless fluorescent lamp in accordance with a second embodiment of the invention.

A second embodiment of an electrodeless high intensity fluorescent lamp in accordance with the invention is shown in FIG. 3. An electrodeless lamp 50 comprises a lamp envelope 52 including two straight tubes 54 and 56 in a parallel configuration. The tubes 54 and 56 are sealed at each end, are interconnected at or near one end by a lateral tube 58 and are interconnected at or near the other end by a lateral tube 60. Each of the tubes 58 and 60 provides gas communication between tubes 54 and 56, thereby forming a closed-loop configuration. The straight tubes 54 and 56 have an important advantage over other shapes in that they are easy to make and easy to coat with phosphor. However, as noted above, the lamp can be made in almost any shape, even an asymmetrical one, that forms a closed-loop discharge path. In a preferred embodiment, each of the tubes 54 and 56 was 40 cm long and 5 cm in diameter. The lateral tubes, 58 and 60 were 3.8 cm long and 3.8 cm in diameter. Increasing the diameter of tubes 54 and 56 decreases discharge voltage and thereby decreases ferrite losses. Reducing the diameter of tubes 58 and 60 to 3.8 cm decreases ferrite sizes and also decreases ferrite losses.

The lamp shown in FIG. 3 was filled with 0.2 torr krypton buffer gas and 6 millitorr of mercury vapor. A transformer core 62 was mounted around lateral tube 58, and a transformer core 64 was mounted around lateral tube 60. Each transformer core was a BE2 toroidal ferrite core that was cut into two pieces with its ends polished. A primary winding of eight turns of wire was wrapped around each ferrite core. Each core had an outside diameter of 8.1 cm, an inside diameter of 4.6 cm, a cross section of 4.4 $cm^2$ and a volume of 88 $cm^3$. The primary windings were driven with a sinusoidal RF source at a frequency of 200 kHz connected as shown in FIG. 2.

Figure 4:
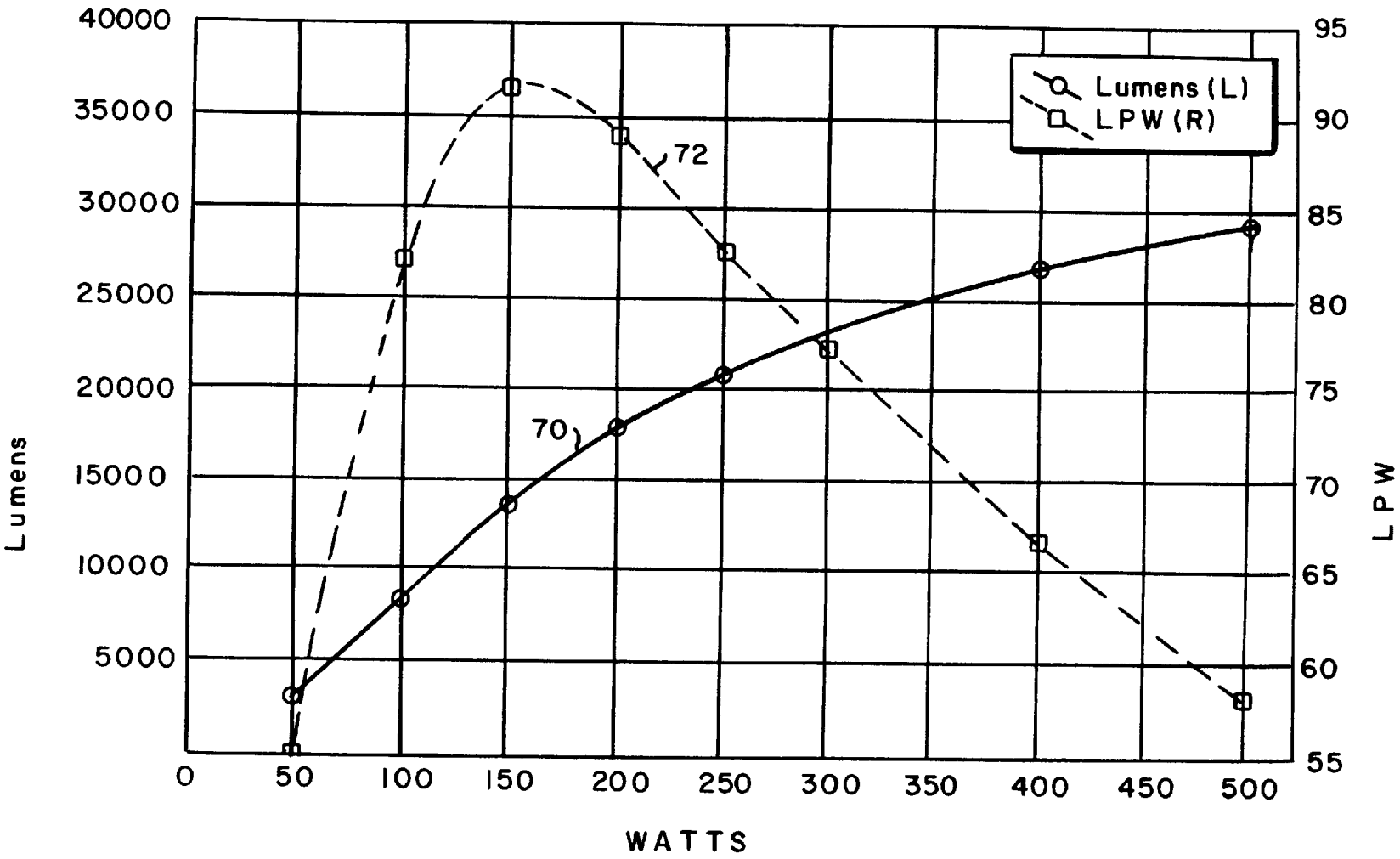
FIG. 4 is a graph of lumens and lumens per watt as a function of discharge power for the electrodeless fluorescent lamp of FIG. 3.

Lumen output and lumens per watt (LPW) for the lamp of FIG. 3 are plotted in FIG. 4 as a function of discharge power. Lumen output is indicated by curve 70, and lumens per watt are indicated by curve 72. The measurements were made at 40° C. cold spot temperature after 100 hours of lamp operation. As shown in FIG. 4, lumen output increases with discharge power, while lumens per watt peaks at 150 watts. At peak LPW, 14,000 lumens are produced with an efficacy (including ferrite core loss) of 92 LPW. The axial lumen density at this LPW is 415 lumens per inch, which is 2.75 times greater than a conventional VHO fluorescent lamp. Discharge current at 150 watts is about 6 amperes. Operation with the parameters disclosed herein makes it possible for the lamp of the present invention to achieve relatively high lumen output, high efficacy and high axial lumen density simultaneously, thus making it an attractive alternative to conventional VHO fluorescent lamps and high intensity, high pressure discharge lamps.

Figure 5:
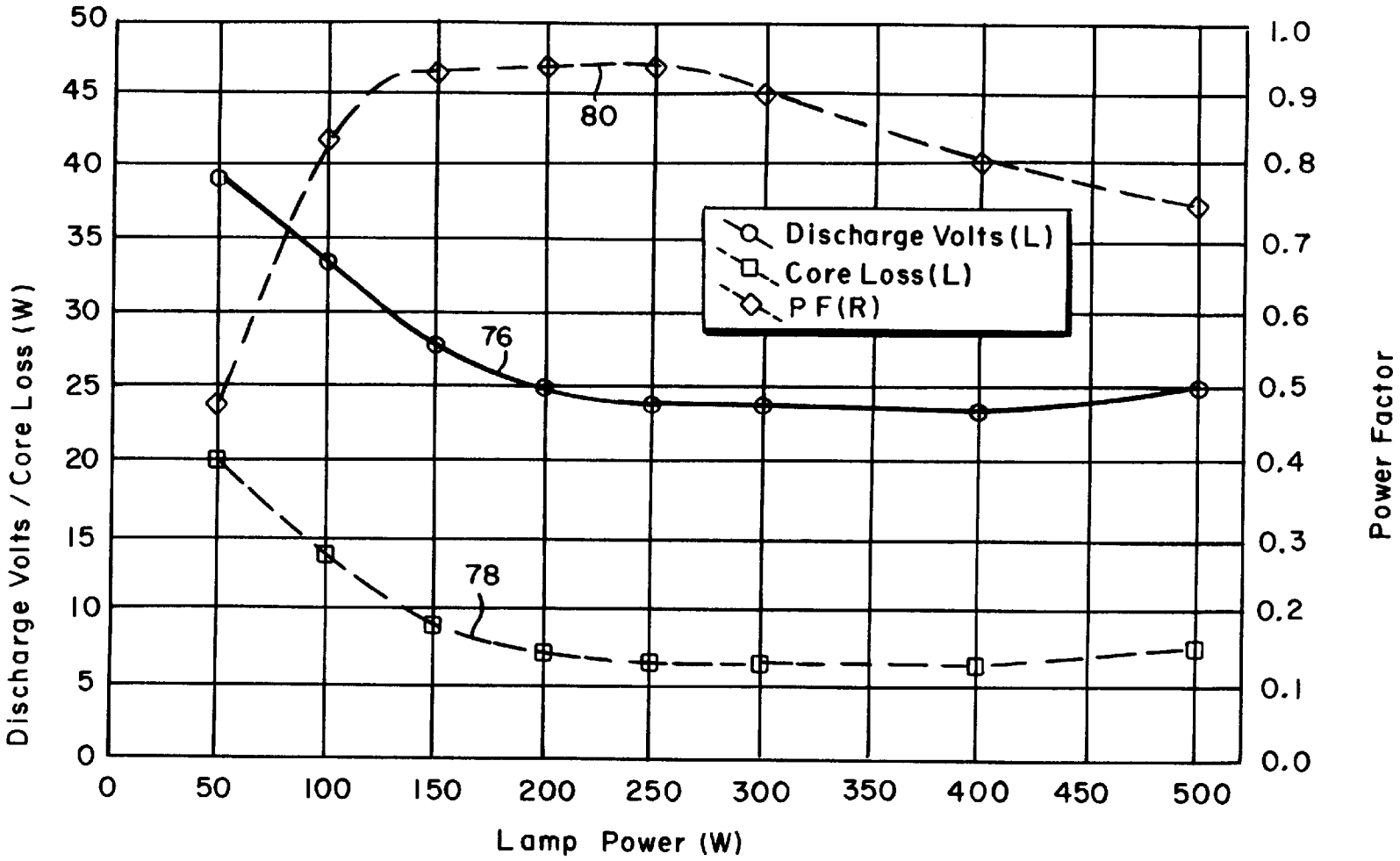
FIG. 5 is a graph of discharge volts, core loss and power factor as a function of lamp power for the electrodeless fluorescent lamp of FIG. 3.

Selected electrical characteristics of the lamp of FIG. 3 are plotted in FIG. 5 as a function of lamp power in watts. Discharge voltage is represented by curve 76; core loss is represented by curve 78; and power factor is represented by curve 80. Discharge voltage and core loss are referenced to the left ordinate, while power factor is referenced to the right ordinate. As lamp power increases, discharge voltage decreases. The decreased discharge voltage results in a corresponding decrease in core loss. FIG. 5 emphasizes the importance of keeping the discharge voltage low. The core loss is 40% of total lamp power at 50 watts, while core loss is only about 6% of total lamp power at 150 watts. The increase in LPW with discharge power up to 150 watts shown in FIG. 4 is primarily related to the corresponding decrease in core loss. The remarkable overall performance of the lamp is due to the choice of operating parameters (primarily gas pressure, temperature, discharge tube diameter and discharge current). The BE2 core material is not considered to be the optimum core material. Measurements have indicated that the core loss may be reduced by almost a factor of two by using a premium core material such as 3 F3 manufactured by Philips.

At 150 watts, the average electric field in the discharge is about 0.75 volts per inch. Such a small electric field in an electroded discharge would result in a rather inefficient light source, since the electrode drop would be appreciable (virtually no light comes from the electrode drop region) with respect to the total discharge voltage. With regard to cathode evaporation and efficacy, an electroded discharge could not operate for a long period under these conditions. By contrast, the lamp of the present invention is expected to have an extremely long life because of its electrodeless configuration.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp assembly comprising:

an electrodeless lamp including a closed-loop, tubular lamp envelope enclosing mercury vapor and a buffer gas at a pressure less than 0.5 torr;

a transformer core disposed so as to surround a portion of said closed-loop lamp envelope;

an input winding disposed on said transformer core; and a radio frequency power source coupled to said input winding for supplying sufficient radio frequency energy to said mercury vapor and said buffer gas to produce in said lamp envelope a discharge having a discharge current equal to or greater than about 2 amperes.

2. An electric lamp assembly as defined in claim 1 wherein said discharge emits ultraviolet radiation and wherein said electrodeless lamp includes a phosphor on an inside surface of said lamp envelope for emitting radiation in a predetermined wavelength range in response to the ultraviolet radiation emitted by said discharge.

3. An electric lamp assembly as defined in claim 1 wherein said radio frequency power source has a frequency in a range of 50 kHz to 3 MHz.

4. An electric lamp assembly as defined in claim 1 wherein said radio frequency power source has a frequency in a range of 100 kHz to 400 kHz.

5. An electric lamp as defined in claim 1 wherein said buffer gas comprises a noble gas.

6. An electric lamp assembly as defined in claim 1 wherein said buffer gas comprises krypton.

7. An electric lamp assembly defined in claim 1 wherein said tubular lamp envelope has a cross-sectional dimension in a range of about 1 to 4 inches.

8. An electric lamp assembly defined in claim 1 wherein said transformer core has a toroidal configuration.

9. An electric lamp assembly defined in claim 1 further including a second transformer core disposed so as to surround another portion of said closed-loop lamp envelope and a second input winding disposed on said second transformer core and coupled to said radio frequency power source.

10. An electric lamp assembly defined in claim 1 wherein said closed-loop lamp envelope has an oval shape.

11. An electric lamp assembly defined in claim 1 wherein said lamp envelope comprises first and second parallel tubes joined at respective ends thereof provide said closed-loop lamp envelope.

12. An electric lamp assembly defined in claim 1 wherein said transformer core comprises a ferrite material.

13. An electric lamp assembly defined in claim 12 wherein a core power loss is associated with said transformer core, wherein a total power is supplied by said radio frequency source and wherein said electric lamp assembly is configured shuch that said core power loss is less than or equal to 15% of the total power supplied by said radio frequency power source.

14. An electric lamp assembly as defined in claim 12 wherein said electrodeless lamp and said transformer core are configured such that a ratio of transformer core volume of said transformer core to discharge power associated with said electrodeless lamp is less than two cubic centimeters per watt.

15. An electric lamp assembly as defined in claim 1 configured such that the pressure in said lamp envelope is equal to or less than 0.2 torr and the discharge current is equal to or greater than 5 amperes.

16. An electric lamp assembly as defined in claim 1 wherein said lamp envelope comprises an ultraviolet-transmissive material and said electrodeless lamp emits ultraviolet radiation in response to said discharge.

17. An electric lamp assembly comprising:

an electrodeless lamp including a tubular lamp envelope enclosing mercury vapor and a buffer gas at a pressure less than 0.5 torr, said lamp envelope comprising first and second parallel tubes joined at a near one end thereof by a first lateral tube and joined at or near the other end thereof by a second lateral tube to provide a closed loop;

a first transformer core disposed so as to surround the first lateral tube of said lamp envelope;

a second transformer core disposed so as to surround the second lateral tube of said lamp envelope;

first and second input windings disposed on said first and second transformer cores, respectively; and a radio frequency power source coupled to said first and second input windings for supplying sufficient radio frequency energy to said mercury vapor and said buffer gas to produce in said lamp envelope a discharge having a discharge current equal to or greater than 2 amperes.

18. An electric lamp assembly as defined in claim 17 wherein said discharge emits ultraviolet radiation and wherein said electrodeless lamp includes a phosphor on an inside surface of said lamp envelope for emitting visible radiation in response to the ultraviolet radiation emitted by said discharge.

19. An electric lamp assembly as defined in claim 17 wherein said lamp envelope comprises an ultraviolet-transmissive material and said electrodeless lamp emits ultraviolet radiation in response to said discharge.

20. An electric lamp assembly as defined in claim 17 wherein said radio frequency power source has a frequency in a range of 50 kHz to 3 MHz.

21. An electric lamp assembly as defined in claim 17 wherein said first and second parallel tubes of said lamp envelope each have a respective cross-sectional dimension in a range of 1 to 4 inches.

22. An electric lamp assembly as defined in claim 17 wherein said first transformer core and said second transformer core each has a respective toroidal configuration.

23. An electric lamp assembly as defined in claim 17 wherein said first transformer core and said second transformer core each comprise a respective ferrite material.

24. An electric lamp assembly as defined in claim 17 wherein the pressure in said lamp envelope is less than or equal to 0.2 torr and said discharge current is equal to or greater than 5 amperes.

25. A method for operating an electric lamp comprising an electrodeless lamp including a closed-loop, tubular lamp envelope enclosing a buffer gas and mercury vapor, comprising the steps of:

establishing a pressure, of said mercury vapor and said buffer gas, in said lamp envelope of less than 0.5 torr; and inductively coupling sufficient radio frequency energy to said mercury vapor and said buffer gas to produce in said lamp envelope a discharge having a discharge current equal to or greater than 2 amperes.

26. A method for operating an electric lamp as defined in claim 25 wherein the step of establishing a pressure includes establishing a pressure of said mercury vapor and said buffer gas less than or equal to 0.2 torr and wherein the step of inductively coupling radio frequency energy comprises inductively coupling sufficient radio frequency energy to produce said discharge current at a level equal to or greater than 5 amperes.

27. An electric lamp assembly comprising:

an electrodeless lamp including a closed-loop, tubular lamp envelope enclosing mercury vapor and a buffer gas at a pressure of less than 0.5 torr; and means for inductively coupling sufficient radio frequency energy to said mercury vapor and said buffer gas to produce in said lamp envelope a discharge having discharge current equal to or greater than 2 amperes.

28. An electric lamp assembly as defined in claim 27 wherein said discharge emits ultraviolet radiation and wherein said electrodeless lamp includes a phosphor on an inside surface of said lamp envelope for emitting radiation in a predetermined wavelength range in response to the ultraviolet radiation emitted by said discharge.

29. An electric lamp assembly as defined in claim 27 wherein said radio frequency energy has a frequency in a range of 50 kHz to 3 MHz.

30. An electric lamp assembly as defined in claim 27 wherein said buffer gas comprises krypton.

31. An electric lamp assembly as defined in claim 27 wherein said tubular lamp envelope has a cross sectional dimension in a range of 1 to 4 inches.

32. An electrodeless lamp assembly comprising:

an electrodeless lamp including a closed-loop, tubular lamp envelope enclosing krypton and mercury vapor at a pressure less 0.5 torr;

a ferrite transformer core disposed so as to surround a portion of said closed-loop lamp envelope; and an input winding disposed on said transformer core for coupling to a radio frequency power source.

* * * * *

UNITED STATES PATENT AND TRADEMARK OFFICE

CERTIFICATE OF CORRECTION

PATENT NO. : 5,834,905
APPLICATION NO. : 08/624043
DATED : November 10, 1998
INVENTOR(S) : Godyak et al.

It is certified that error appears in the above-identified patent and that said Letters Patent is hereby corrected as shown below:

Claims,

Claim 1, Column 8,
Line 19, delete “about”;

Claim 11, Column 8,
Line 51, after “thereof” insert --to--; and

Claim 13, Column 8,
Line 59, delete “shuch” and insert --such--.

Signed and Sealed this

Fourteenth Day of October, 2008

JON W. DUDAS
*Director of the United States Patent and Trademark Office*